US005565063A

United States Patent [19]

Begemann et al.

[11] Patent Number: 5,565,063

[45] Date of Patent: Oct. 15, 1996

[54] DEVICE AND METHOD FOR CHOKING A STOCK SUSPENSION FLOW IN A PAPER MACHINE

[75] Inventors: Ulrich Begemann, Leonberg; Helmut Heinzmann, Bohmenkirch, both of Germany

[73] Assignee: J. M. Voith GmbH, Heidenheim, Germany

[21] Appl. No.: 268,288

[22] Filed: Jun. 30, 1994

[30] Foreign Application Priority Data

Jul. 5, 1993 [DE] Germany ..... 43 22 323.0
Jan. 28, 1994 [DE] Germany ..... 44 02 515.7

[51] Int. Cl.[6] ..... D21F 1/00; F15D 1/00

[52] U.S. Cl. ..... 162/216; 138/46; 138/45; 138/44; 138/43

[58] Field of Search ..... 138/46, 45, 44, 138/43, 42; 162/216

[56] References Cited

U.S. PATENT DOCUMENTS

| | | | |
|---|---|---|---|
| 2,517,083 | 8/1950 | Carlson | 138/46 |
| 2,833,311 | 5/1958 | Baldelli | 138/43 |
| 3,095,006 | 6/1963 | Smith | 137/269.5 |
| 3,954,124 | 5/1976 | Self | 138/42 |
| 4,850,336 | 7/1989 | Hogan | 126/307 R |
| 5,156,750 | 10/1992 | Henricson | 210/783 |

*Primary Examiner*—Donald E. Czaja
*Assistant Examiner*—Calvin Padgett
*Attorney, Agent, or Firm*—Baker & Daniels

[57] ABSTRACT

A throttle device for stock suspensions in a paper machine including a feed line, a drain line and a spatially variable cavity connecting the feed line and drain line with each other. The cavities provided with a plurality of nestable walls in which the nesting effects a lengthening of the flow path.

6 Claims, 1 Drawing Sheet

DEVICE AND METHOD FOR CHOKING A STOCK SUSPENSION FLOW IN A PAPER MACHINE

BACKGROUND OF THE INVENTION

The invention concerns a device and a method for choking a stock suspension flow in a paper machine or system for stock treatment.

For choking fluid flows, valves of various designs are prior art. A considerable disadvantage of these standard valves, such as ball valves, needle valves, flap valves, slide valves and similar, is that for generating the desired flow resistance they must create very narrow cross sections, which normally tend to clogging when the fluid passing through them carries fibers.

Reference is made to the unpublished German patent application P 42 39 643. It presents a throttle device which for choking a fluid flow essentially utilizes turbulence phenomena which occur or are generated therefor and, thus, can dispense with narrow cross sections. An unfavorable characteristic of this device is its limited working range.

The problem underlying the invention is to describe a throttle device which is suited specifically for use in paper machines and, for one, is with regard to the clogging tendency less susceptible than the standard valves and, for another, has a working range greater than the throttle device presented in the aforementioned patent application. An example of a paper making machine in which the throttle device of the present invention can be used is disclosed in U.S. Pat. No. 4,050,479, which patent is expressly incorporated herein by reference.

SUMMARY OF THE INVENTION

This problem is solved by providing a throttle device for stock suspensions wherein the length of the flow path within the throttle device is varied continuously or discretely. For example, the cavity in the throttle device can be provided with a plurality of nestable walls in which the nesting causes a lengthening of the flow path.

It is recognized that the avenue chosen in standard fashion for generating a variable resistance in a throttle device consists in altering a cross section, with the peak losses generated there determining the level of resistance. This gives rise to the possible generation of undefined eddies and, thus, cloggings respectively, when using such throttle devices for stock suspensions in a paper machine, of so-called fiber tuft formations capable of impairing the paper quality.

A possible other way to generate resistance, notably when the width of the generated resistance remains within limits, is altering the flow path. This can be accomplished, e.g., by lengthening the flow path, for instance in that the stock suspension is passed along a zig-zag course within the throttle device with variable amplitude, or in that a rotational component is added to a flow pattern which in basic state is approximately rectilinear, so that the more or less pronounced rotation entails a correspondingly longer path for the flow to pass. Another way of choking a flow is constituted by withdrawing energy from the flow due to variably heavy eddy formation or in that successively arranged accelerating and retarding stretches are installed in the throttle device. Of course, there is also the option of combining the effects described above with one another, whereby, for example, cleaning effects of favorable action can be utilized as well.

BRIEF DESCRIPTION OF THE DRAWINGS

The invention will be more fully described with the aid of the figures, which show the following.

DETAILED DESCRIPTION

Figure 1:
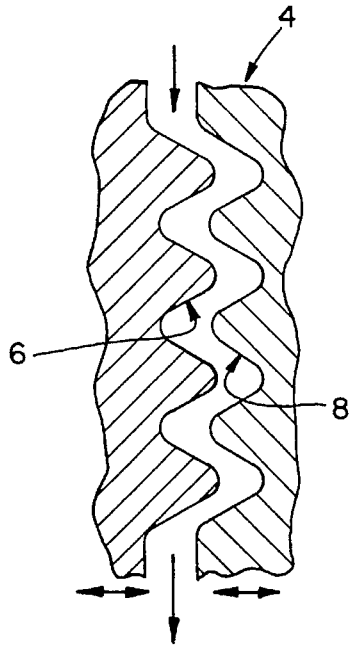
FIGS. 1 through 3 are cross sectional views of three variants of a throttle device according to the present invention.

FIG. 1 shows schematically a throttle device 4 in which two wavy surfaces 6 and 8 can be moved both toward and away from each other without the surface being in mutually engaging contact. That is, with a diminishing spacing of the surfaces 6 and 8, a path that becomes ever longer is imposed on the fluid passing between the two surfaces, which is accompanied by an increase in resistance. Importantly, the resistance generated here does not result from peak effects through extreme constrictions, but merely from a lengthened path of the fluid. The invention also provides the option of moving the two opposed surfaces 6 and 8 in relative longitudinal directions so that, as the spaces are passed by the fluid, accelerating and retarding effects occur additionally, since the flow is required to traverse areas of alternating larger and smaller cross sections.

Figure 2:
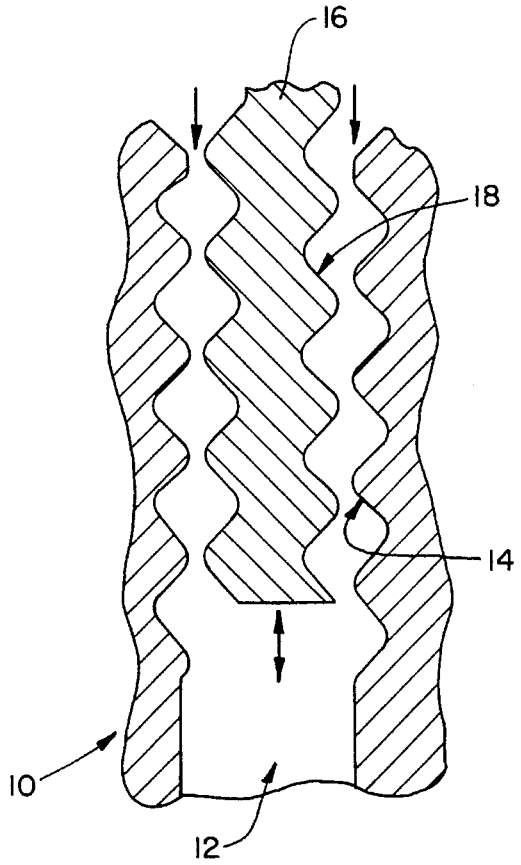

FIG. 2 shows another inventional throttle device 10. Here, the fluid is made to pass through an approximately cylindrical cavity 12 whose interior wall 14 undulates spirally. A piston 16 which as well is undulated, preferably spirally and evenly, on its outside surface 18 is axially inserted into said cavity. With the piston 16 retracted completely from the narrower section, the fluid can flow through the throttle device nearly unimpededly, taking the direct, rectilinear path. Pushing the piston 16 into the constriction 12 forces the fluid to assume a spiral flow pattern, requiring the flow to travel an ever lengthening path as the piston 16 is pushed in increasingly and, consequently, causing also the resistance to the flow to rise. Important is here as well that the resistance is not generated due to extreme constrictions, but merely through the longer path traveled, which naturally engenders also elevated resistance.

Figure 3:
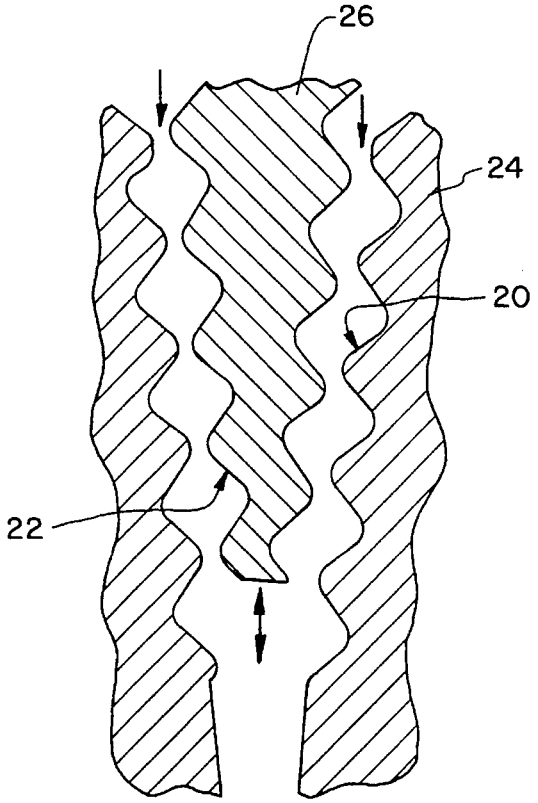

FIG. 3 shows an embodiment of a throttle device similar to FIG. 2, but the mating surfaces 20 and 22 of cylinder 24 and piston 26, respectively, are conic in their basic shape.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a throttle device for a liquid stock suspension comprising:

a feed line;

a drain line; and a spatially variable cavity defining a flow path and connecting the feed line and drain line with each other, said cavity having a plurality of nestable walls which in nesting causes a lengthening of the flow path for the liquid flowing through said cavity without said plurality of nestable walls being in mutual engaging contact.

2. In a paper machine, a throttle device for a liquid stock suspension, comprising:

a feed line;

a drain line; and a spatially variable cavity connecting the feed line and drain line with each other, said cavity having spiral bosses and hollows extending around a major flow direction for the liquid suspension, said major flow direction extending from said feed line to said drain line and being substantially parallel to an axis of said cavity, the amplitude of the hollows and bosses being adjustable without said hollows and bosses being in mutually engaging contact.

3. In a paper machine, a throttle device for a liquid stock suspension, comprising:

a feed line;

a drain line;

a spatially variable cavity connecting the feed line and drain line with each other, said cavity having an interior surface provided with spiral hollows and bosses extending around a major flow direction of the liquid suspension, said major flow direction extending from said feed line to said drain line and being substantially parallel to an axis of said cavity; and a displacement body provided generally centrally in said cavity, the displacement body being variably positioned in the cavity and not in engaging contact with said interior surface of said cavity.

4. In a paper machine, a throttle device for a liquid stock suspension, comprising:

a feed line;

a drain line;

a spatially variable cavity connecting the feed line and drain line with each other, said cavity having an interior surface that is generally tapered and is provided with spiral hollows and bosses extending around a major flow direction of the liquid suspension, said major flow direction extending from said feed line to said drain line and being substantially parallel to an axis of said cavity; and a displacement body being provided centrally in said cavity, said displacement body having an external surface that is generally tapered and axially parallel to said cavity, said displacement body being movable within said cavity along its taper axis and not in engaging contact with said interior surface of said cavity.

5. The paper machine of claim 4 wherein the external surface of said displacement body comprises spiral bosses and hollows around the taper axis of said displacement body.

6. The paper machine of claim 3 characterized in that said displacement body has an external surface including spiral bosses and hollows around an axis of said displacement body.

* * * * *